US009295906B2

(12) United States Patent
Johnson et al.

(10) Patent No.: US 9,295,906 B2
(45) Date of Patent: Mar. 29, 2016

(54) COLLECTION OF NAIL HAMMERING GAME PIECES

(71) Applicants: Marc Johnson, Oakfield, NY (US); James Betters, Leroy, NY (US); Daniel J. Manges, Oakfield, NY (US)

(72) Inventors: Marc Johnson, Oakfield, NY (US); James Betters, Leroy, NY (US); Daniel J. Manges, Oakfield, NY (US)

(73) Assignee: Eichenfeld, LLC., Oak Field, NY (US)

( * ) Notice: Subject to any disclaimer, the term of this patent is extended or adjusted under 35 U.S.C. 154(b) by 113 days.

(21) Appl. No.: 14/326,057

(22) Filed: Jul. 8, 2014

(65) Prior Publication Data

US 2016/0008706 A1 Jan. 14, 2016

(51) Int. Cl.
*A63F 9/00* (2006.01)
*A63F 11/00* (2006.01)

(52) U.S. Cl.
CPC ..... *A63F 9/00* (2013.01); *A63F 11/0025* (2013.01); *A63F 2011/0032* (2013.01)

(58) Field of Classification Search
CPC A63F 9/00; A63F 11/0025; A63F 2011/0032
USPC ..... 273/440, 445, 446, 459, 461
See application file for complete search history.

(56) References Cited

U.S. PATENT DOCUMENTS 1,304,540 A * 5/1919 Burrowes ..... A63F 1/06 108/125
1,555,993 A 10/1925 Larson
2,029,434 A * 2/1936 Mitchell ..... A47B 3/12 108/151
2,540,061 A * 1/1951 Szantay ..... A63H 33/00 235/90
2,610,055 A * 9/1952 Goodyear ..... A63D 3/00 273/118 R
2,837,862 A * 6/1958 Cleveland ..... A63H 33/00 446/1
2,871,618 A * 2/1959 Reynolds ..... A63H 33/00 446/1
3,001,843 A * 9/1961 Davis ..... A47B 25/00 108/11
3,608,903 A * 9/1971 Cooper ..... A63F 9/0079 273/236
RE28,293 E * 1/1975 Bustos ..... A47B 57/265 108/107
5,078,404 A * 1/1992 Barillaro ..... A63F 3/00157 273/285
5,092,591 A 3/1992 Tol
5,207,793 A * 5/1993 Brand ..... A63F 9/30 273/440
D349,135 S * 7/1994 Strayer ..... D21/470
6,505,565 B1 * 1/2003 Byung ..... A47B 3/00 108/115
6,662,732 B2 * 12/2003 Birsel ..... A47B 21/00 108/25
6,935,630 B2 * 8/2005 Giegerich ..... A63F 3/0023 273/239
6,997,111 B2 * 2/2006 Giegerich ..... A47B 3/002 108/115
8,006,979 B1 * 8/2011 Lamm ..... A63F 3/00119 273/276
8,795,047 B2 * 8/2014 Tsai ..... A63F 9/0096 273/446

OTHER PUBLICATIONS

Hammer Time! Mike Siemsen's School of Woodworking, submitted May 19, 2012 [online], [retrieved on Dec. 28, 2015]. Retrieved from the Internet <URL: http://schoolofwood.com/node/68>.*

* cited by examiner

*Primary Examiner* — Raleigh W Chiu
(74) *Attorney, Agent, or Firm* — Tracy Jong Law Firm; Tracy P. Jong; Cheng Ning Jong

(57) ABSTRACT

A collection of game pieces including a block and a support tray. The block includes a top surface, a first width and a thickness. The support tray includes a top surface, a bottom surface, a second width, a depressed portion on the surface and the support tray is adapted to removably receive the block centrally on the top surface. The ratio of the first width and the second width ranges from about 6:7 to about 1:2 such that a flange of the support tray is formed. The block is configured to receive a plurality of nails driven into it using a striking tool and if the striking tool accidentally misses the block while used in driving a nail into the block, the flange is used to arrest the striking motion of the striking tool.

18 Claims, 9 Drawing Sheets

COLLECTION OF NAIL HAMMERING GAME PIECES

BACKGROUND OF THE INVENTION

1. The Field of the Invention

The present invention is directed generally to a collection of nail hammering game pieces. More specifically, the present invention is directed to a collection of portable and easily transportable and set up Hammerschlagen or Nagelspielen or nail hammering game pieces.

2. Background Art

The object of the nail hammering game is for two or more players to drive nails into a tree stump. The fewer the number of strokes it takes to drive a nail into the stump, the higher the score will be. There are many different ways to play and many different sets of rules. However, the essence of the game is to hammer a nail into the tree stump.

According to the website http://www.salinemainstreet.org/2012/09/08/new-event-at-oktoberfest/:, Hammerschlagen or Nagelspielen is defined as follows:

"Hammer-Schlagen (the "Striking Hammer" or "Hammer-Striking") is a brand of the German game Nailspielen (the "Nail Game" or "Playing With Nails") which reportedly dates to the first Oktoberfest in 1810. Shortly after opening in 1966, the first instance of Nailspielen in the United States was reportedly found at the Gasthaus Bavarian Hunter in Stillwater, Minn. It was played there in the traditional fashion until the restaurant owner's father branded the Nailspielen service[1] and vested the brand of Hammer-Schlagen and the related intellectual property in WRB, Inc.[2]

Both Hammer-Schlagen and Nailspielen are essentially the same. Nailspielen is played with an axe while Hammerschlagen is played with a hammer.

The game is typically played with a Cross-peen hammer or blacksmith's hammer and a large (24-36") cross-section of a soft hardwood. Cottonwood is suitably soft for this game. The hammer must have a wedge-shaped (but not sharp) end on it and should be at least 2.5 pounds.

The log is set up waist high with the flat sides facing the floor and ceiling. A bright common nail (12/16d) is driven about a half inch into the wood in front of each player. Each player's turn consists of setting the wedge-end of the hammer on the log next to their nail and taking a single swing at it. The swing must be done in a smooth up and down motion. Male players must use one hand. Female players may use both hands.

Sound easy? It is more challenging than you think! Frequently, a player will bend their nail in such a way as to make driving it further nearly impossible. In this case, the player may use their turn to make a single-motion swing at the nail from the side in an attempt to straighten the nail. You are not required to stand in the same place for the entire game. Often it is necessary to switch sides of the log to get a better angle on your nail."

One disadvantage associated with conventional game pieces lies in the size of a stump used to play the game as it often is too heavy and bulky to transport. Players or organizers of such game are faced with several difficulties which have prevented more popular acceptance of such game. First, suitably sized and conditioned wood blocks must be selected from non-purposely cut tree trunks. The selection process may be complicated by factors such as the variety of tree the blocks have originated from, the condition of the blocks due to weathering and health conditions of the tree from which the blocks have originated from, the quality of the cuts as the top surface of a slice may not be substantially parallel with the bottom surface of the slice, the size and weight of the blocks, and the like. Then, once a block has been selected, there is the issue of supporting the block which is usually disposed and supported outdoors. The support preferably does not present a barrier (especially to the toes) to a user approaching the block but yet should be sufficiently sturdy such that any conceivably placed weight, e.g., due to the impact created by a striking tool while nail striking is attempted, does not cause the block to fall off of the support.

Thus, there arises a need for nail hammering game pieces which are easily transportable and ones which solve all of the problems associated with procuring, transporting, deploying, gathering and using conventional nail hammering game pieces.

SUMMARY OF THE INVENTION

The present invention is directed toward a collection of game pieces including a block and a support tray. The block includes a top surface, a first width and a thickness. The support tray includes a top surface, a bottom surface, a second width, a depressed portion on the surface and the support tray is adapted to removably receive the block centrally on the top surface. The ratio of the first width and the second width preferably ranges from about 6:7 to about 1:2 such that a flange of the support tray is formed. The block is configured to receive a plurality of nails driven into it using a striking tool and if the striking tool accidentally misses the block while used in driving a nail into the block, the flange is used to arrest the striking motion of the striking tool.

In one embodiment, at least one leg socket is adapted to the bottom surface. A leg structure is removably connected to the at least one leg socket to support the support tray.

In one embodiment, the leg structure is collapsible to facilitate transport of the leg structure.

In one embodiment, the leg structure includes four legs capable of being erected in a rectangular stance. Each of the four legs includes a top end and a bottom end.

In one embodiment, each of the four legs includes a foot disposed on the bottom end of the leg.

In one embodiment, each of the four legs further includes an aperture disposed on the foot of the leg, where the aperture is adapted to receive a stake.

In one embodiment, the block includes a material having a density of from about 20 to about 40 lbs/ft$^3$.

In one embodiment, the block includes a material having a Janka hardness of from about 350 to about 550.

The material can include natural wood, a glulam, Medium-Density Fiberboard (MDF) and Urethane Foam Board.

In one embodiment, the top surface of the support tray further includes a depressed portion adapted to form a fringe to secure the block.

In one embodiment, the top surface of the support tray further includes at least one key configured to be coupled to a matching slot of the block to prevent movement of the block relative to the support tray and to prevent use of an unqualified block.

In one embodiment, the game pieces further include a carrying strap having two ends, each end adapted to a portion of the support tray to facilitate transport of the support tray.

In one embodiment, the size of each of the plurality of nails is about 10 d.

In one embodiment, the thickness of the block ranges from about 4 inches to about 6 inches and the first width ranges from about 10 inches to about 16 inches.

In one embodiment, the top surface of the block further includes a marking designation disposed at a pre-determined distance from an edge of the block.

In one embodiment, the game pieces further include at least one level for indicating inclination of the support tray about one axis of rotation.

Accordingly, it is a primary object of the present invention to provide portable nail hammering game pieces.

It is another object of the present invention to provide a portable playing surface and a base assembly that are durable and easy to assemble and disassemble.

It is another object of the present invention to provide a collection of portable nail hammering game pieces that is aesthetically pleasing and requires only very few parts.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
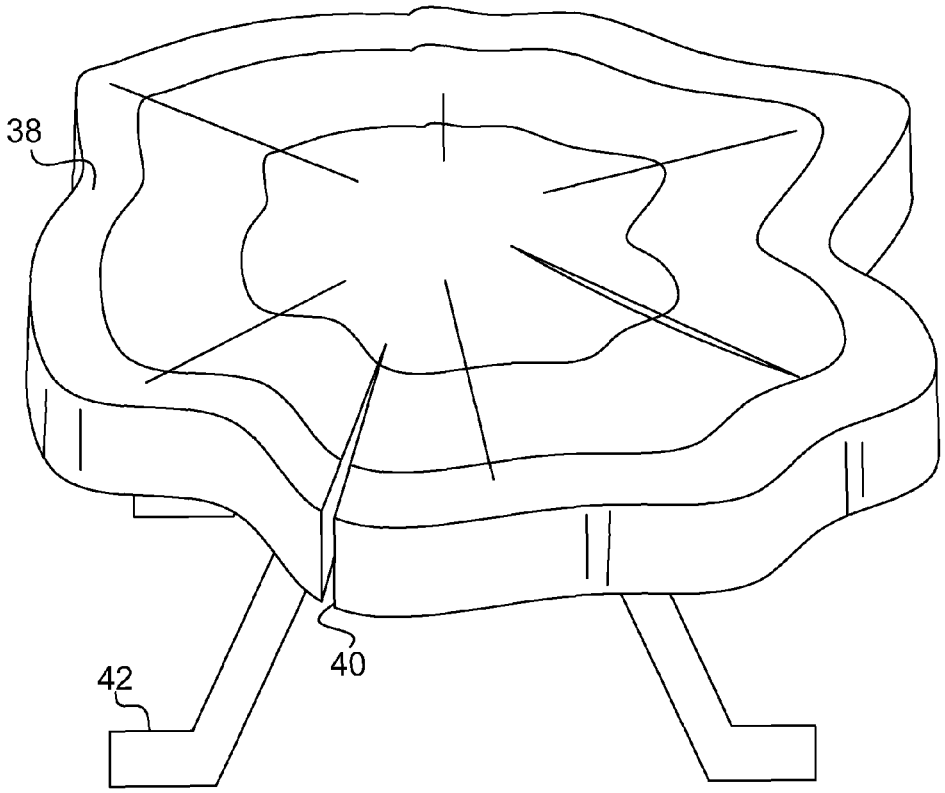
PRIOR ART FIG. 1
FIG. 1 depicts a conventional wood block supported on a support structure where the wood block is useful for receiving nails in a nail hammering game.

2—nail hammering game pieces
4—block
6—support tray
8—flange
10—leg socket
12—leg structure
14—carrying strap
16—striking tool or hammer
18—nail
20—head of hammer
22—tail of hammer
24—measuring mark disposed on hammer tail
26—spring loaded button
27—aperture
28—foot of leg
30—aperture of foot
32—height at which block is disposed
34—strap length adjustment buckle
36—user
38—sliced natural wood block
40—defects, e.g., cracks, etc.
42—support structure
44—width of block
46—minimum width of flange
48—leg socket securing plate
50—fastener
52—distance between adjacent leg sockets
54—intermediate block
56—seam
58—outline of finished block
60—aggregate strip
62—play between block and support tray
64—key
66—matching slot
68—container
70—fringe
72—thickness of block
74—depressed portion of support tray
76—level
78—marking disposed on top surface on block
80—marking disposed on top surface of block, designating edge of block
82—slideable anchor
84—axis of rotation about a first axis
86—axis of rotation about a second axis
88—wall around depressed portion
90—wall around flange
92—aperture
94—slot
96—through hole
98—screw
100—distance between top end of wall around depressed portion and top surface of seated block

PARTICULAR ADVANTAGES OF THE INVENTION

The present game pieces include a block having consistent density and hardness, making nail driving more predictable and the success of nail driving dependent on skill rather than luck.

The present game pieces include a block having a width that is narrower than the support tray on which the block is supported, leaving a flange around the block to serve as an edge to prevent misses to continue on their paths to cause inadvertent harm to the user and properties. In one embodiment, a fringe is formed around the block as the block is disposed in a depressed portion of the support tray. Such fringe contains any inadvertently separated edges of the block from leaving the support tray and hitting bystanders or the user.

The present game pieces are capable of being assembled and disassembled with ease. As such, they are easily transportable. The block is configured in a size convenient to be transported but yet have sufficient surface for nail driving. The block can be disposed securely atop the support tray. The leg structure is detachable from the support tray such that the support tray can be transported separately from the leg structure. The leg structure is erectable for use but collapsible for transport and storage. Therefore the use of the present game pieces is encouraged due to the ease of transporting, assembling, disassembling and storing such game pieces. This is in direct contrast to the use of a conventional wood block and its support structure which are likely larger, heavier, bulkier and less stable when the wood block is supported on a conventional support structure.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

The present game pieces are provided in a manner that they can be easily provided, managed or transported by a single individual. They include a block made in a size easily transportable by one person, a support tray having a depression for receiving the block, a leg structure for supporting the support tray. In order to use the present games pieces, a supply of suitably selected nails and a hammer are also necessary. In one embodiment, the top surface of the support tray may be flat, i.e., without a depression. In this embodiment, a raised rim adapted to surround and receive a block may be provided.

FIG. 1 depicts a conventional wood block 38 supported on a support structure 42 where the wood block 38 is useful for receiving nails in a nail hammering game. Sliced natural wood blocks 38 that result from normal wood/tree cutting are used. As such, the shape of naturally occurring wood slices or blocks can be unpredictable, inconsistent and subject to the choice of their users. The surfaces of the blocks may be fraught with scars and defects 40 which make the quality of the surfaces inconsistent and not only limiting the amount of usable surface areas but also making the game more dependent on luck as opposed to skill as the choice of nail placements can mean whether a nail can be successfully driven into the block.

Figure 2:
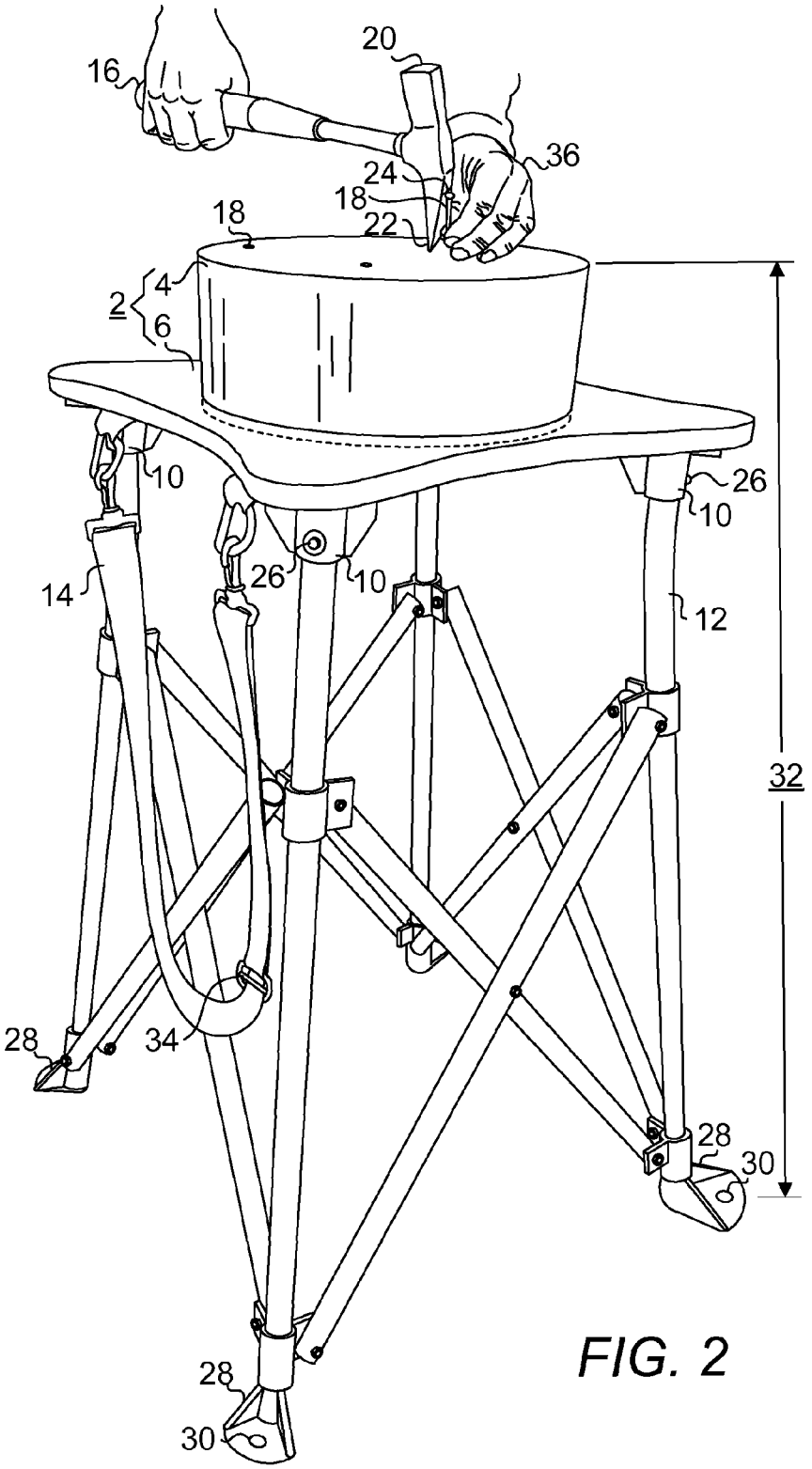
FIG. 2 is a partial top perspective partially transparent view of the present nail hammering game pieces, depicting a user checking the level to which a nail must be inserted in the block before striking of the nail as a matter of game play can start.

FIG. 2 is a partial top perspective partially transparent view of the present nail hammering game pieces 2, depicting a user 36 checking the level to which a nail must be inserted in the block before striking of the nail 18 as a matter of game play can start. A measuring mark 24 is conveniently provided on the hammer tail and as the hammer tail is disposed on the block with the haft of hammer held sufficiently level, the mark shows the required position of the head of the nail before the nail should be struck (or before the count of the number of strikes should begin). In order to insert the nail to appropriate height in the block, the nail 18 is tapped lightly using either the head or the tail of the hammer. Several measurements may be taken before the nail 18 is eventually placed in a satisfactory height for a turn to begin. The present invention includes a collection of game pieces 2 including a block 4 and a support tray 6. As the block 4 is provided as a separate element and removable from the support tray 6, a used block can be easily replaced with a new one without having to dispose of the otherwise usable support tray.

In use, the block 4 is configured to receive a plurality of nails 18 driven into it using a striking tool 16 and if the striking tool 16 accidentally misses the block 4 while used in driving a nail into the block, the flange 8 is used to arrest the striking motion of the striking tool 16. A cross peen hammer, blacksmith's hammer, mason's hammer, framing hammer are found to be suitable striking tool 16 as each such hammer has a blade-like peen at right angles to the haft of the hammer. A blade-like peen poses significant challenges to a user as the striking surface has an area that is not much larger than the head of a nail, causing only the most accurate strikes to actually contact the nail to drive it deeper into a block. All suitable hammers have one feature in common, i.e., the hammer tapers from a head 20 to a reduced portion which becomes the tail 22. It is necessary that the hammer be sufficiently heavy to drive a nail but not too large that it could damage the block from striking it too hard. A 20-ounce mason hammer appears to work the best using the tail. Although less desirable, the head of a hammer may alternatively be used for novice play if agreed upon by all participants.

It shall be noted that the support tray 6 further includes four leg sockets 10 adapted to the bottom surface of the support tray 6. Although a lesser number of leg sockets may suffice, the use of four leg sockets provides receiving points for four legs that are disposed at four corners, resulting in a wide stance for securing legs to provide stability. If a smaller number of leg sockets is used, a smaller number but matching number of legs may be used. In the embodiment shown, a leg structure is removably connected to the leg sockets to support the support tray. The leg structure is preferably easily collapsible to facilitate transport of the leg structure and includes four legs capable of being erected in a rectangular stance easily. Each pair of adjacent legs represents a face of the rectangular stance and includes a scissors type structure that allows the pair to be disposed in its erected position when the scissors type structure is disposed in its fully erected position and collapsed position when the scissors type structure is disposed in its fully collapsed position. The leg structure is preferably portable and lightweight, e.g., constructed from a lightweight material, e.g., steel, aluminum or plastic tubing and wooden frame. A notable feature of the leg structure has to deal with its large "feet" that prevent such stand from sinking into soft ground during use due to hammering forces exerted on the block. The area encompassed by the stance of the legs is preferably larger than the top horizontally disposed surface area of the block or the support tray to prevent or reduce the likelihood of erected game pieces from tipping over by lowering the center of gravity of the erected game pieces. The ground contact area of each foot 28 is preferably sufficiently large to prevent sinking of the feet 28 into soft ground. Preferably, when a nail is being driven into a block, the pressure experienced in each foot 28 does not exceed about 15 lbs/in$^2$(psi). Suitably large feet aid in distributing the weights experienced at the feet and prevent penetration of the feet into the ground on which the legs are disposed. There is further provided at least one aperture 30 in each foot 28 for receiving a stake. Staking down of the legs becomes important to secure the game pieces when the game pieces are erected over uneven and/or soft ground.

In one embodiment, the block includes a material having a density of from about 20 to about 40 lbs/ft$^3$. In one embodiment, the block includes a material having a Janka hardness of from about 350 to about 550. In a preferred embodiment, the block includes a material having a Janka hardness of about 400. Suitably hard materials are important in that the materials are required not only to withstand penetration of nails placed densely together but also repeated misses in hammering the nails. Some spots on a block can potentially experience several blows over the lifetime of the block. In one embodiment, the height of the leg structure is configured such that the top surface of the block is disposed at a height 32 of about 36 inches of a surface upon which the leg structure is disposed.

Figure 2A:
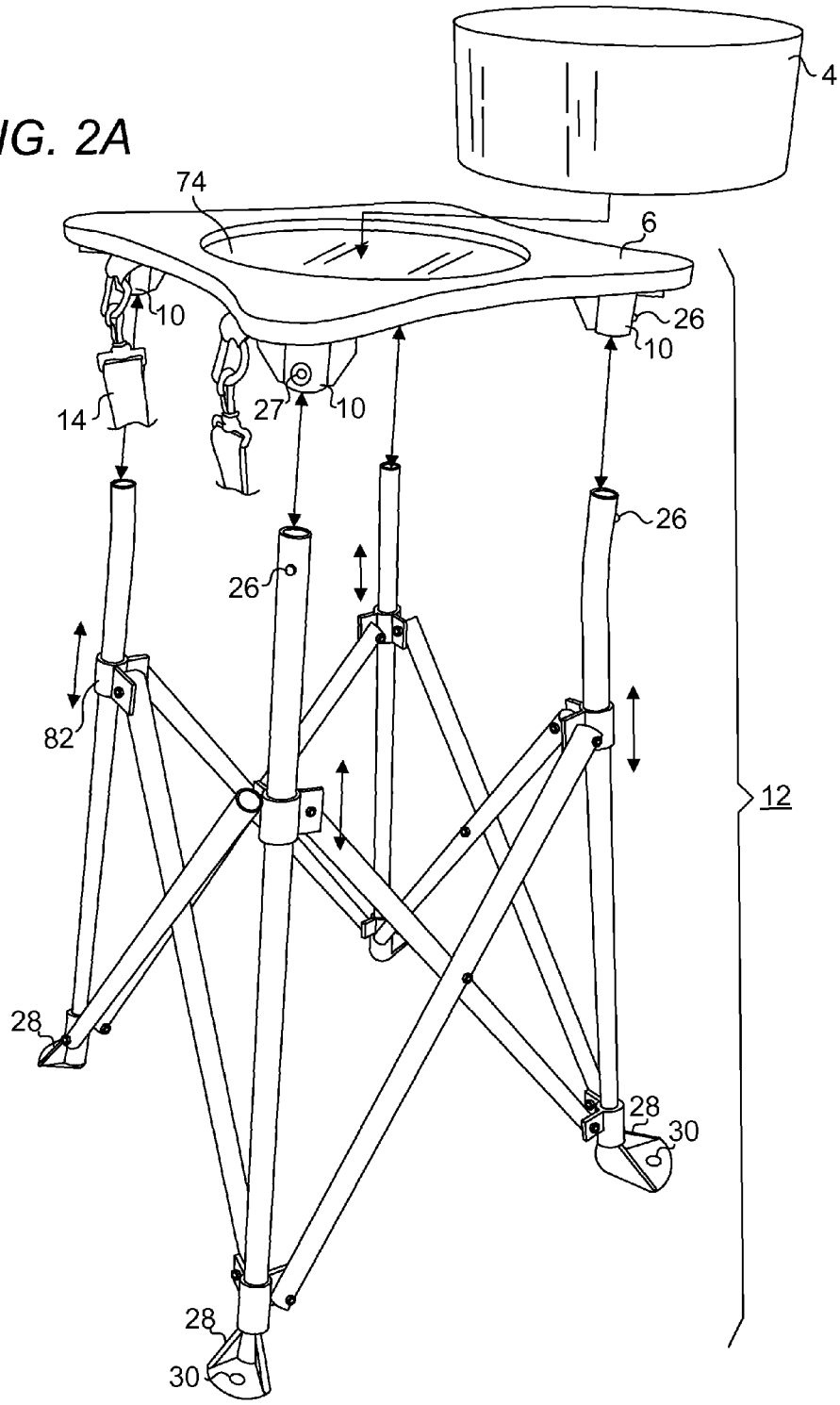
FIG. 2A is a partial top perspective partially transparent exploded view of the present nail hammering game pieces, depicting the interfaces between a block, its support tray and the leg structure connected to the support tray.

FIG. 2A is a partial top perspective partially transparent exploded view of the present nail hammering game pieces, depicting the interfaces between a block 4, its support tray 6 and the leg structure connected to the support tray 6. In erecting the leg structure, the legs are pulled apart, causing the slideable anchors 82 of each pair of the scissors type structure to lower as the scissors type structure spread apart. The leg structure may be placed on a surface including, but not limited to blacktop, concrete, gravel, dirt, grass, carpet, linoleum, frozen lake and snow. Upon erecting the leg structure 12, a support tray 6 is adapted to the leg structure 12 by first aligning each leg socket 10 with the top end of a leg. In the embodiment shown, the top end of each leg is equipped with a spring loaded button 26 which when compressed, collapses to form a smaller overall diameter at the top end of the leg. This reduced diameter enables the insertion of the top end of the leg into a corresponding socket 10 on the support tray 6. The leg will be inserted to a point when the button 26 becomes disposed at a position to coincide with a matching aperture 27 disposed on the socket 10 to receive the button 26. Upon reaching this position, the resilience of the spring loaded button 26 now causes it to extend through the aperture 27, thereby locking the leg in position. In order to remove the leg, the button 26 is simply depressed such that the overall diameter of the leg now becomes smaller than the diameter of the socket 10. The leg can then be pulled from the socket 10 and eventually separated from the socket 10. When a support tray 6 has been set up, a block 4 may then be dropped onto the top surface of the support tray 6. In the embodiment shown, a depressed portion 74 is provided to securely receive the block 4. In collapsing the leg structure, the block 4 is first removed from the support tray 6, followed by the removal of the support tray 6 from the leg structure. When all legs have been detached from their corresponding sockets 10, the legs can now be brought together, causing the slideable anchors 82 to rise in order to accommodate the collapse of the leg structure. It shall be noted that, throughout the entire operations of assembling and disassembling, no external tools are needed. The present game pieces can be set up by a single individual, removing the need for a second individual or third, as in the prior art scenarios, in carrying and setting a large block on a support structure.

Referring back to FIG. 2, it shall be noted that the present game pieces further include a carrying strap 14 having two ends, each end adapted to a portion of the support tray 6 to facilitate the transport of the support tray 6. In yet another embodiment not shown, a handle is used in place of the carrying strap 14. In the embodiment shown, the carrying strap 14 further includes an adjustment buckle 34 which enables length adjustment of the carrying strap 14.

Figure 3:
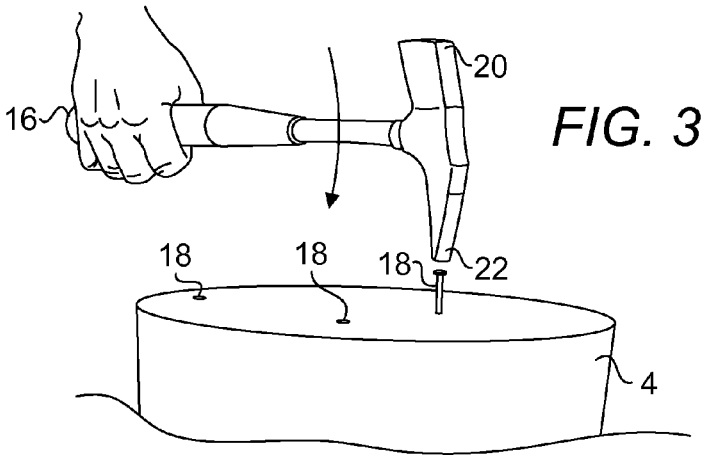
FIG. 3 is a top perspective view of a present block, depicting a user striking a nail into a block.

FIG. 3 is a top perspective view of a present block 4, depicting a user striking a nail 18 into a block 4. It shall be noted that the tail 22 of the hammer is used in striking the nail 18 at its head. The head 20 of the hammer is typically not used as it is not sufficiently challenging to use it to strike a nail with the head 20. It shall be noted that two nails 18 have already been struck and now embedded in the block 4 with only the heads of the nails exposed.

Figure 4:
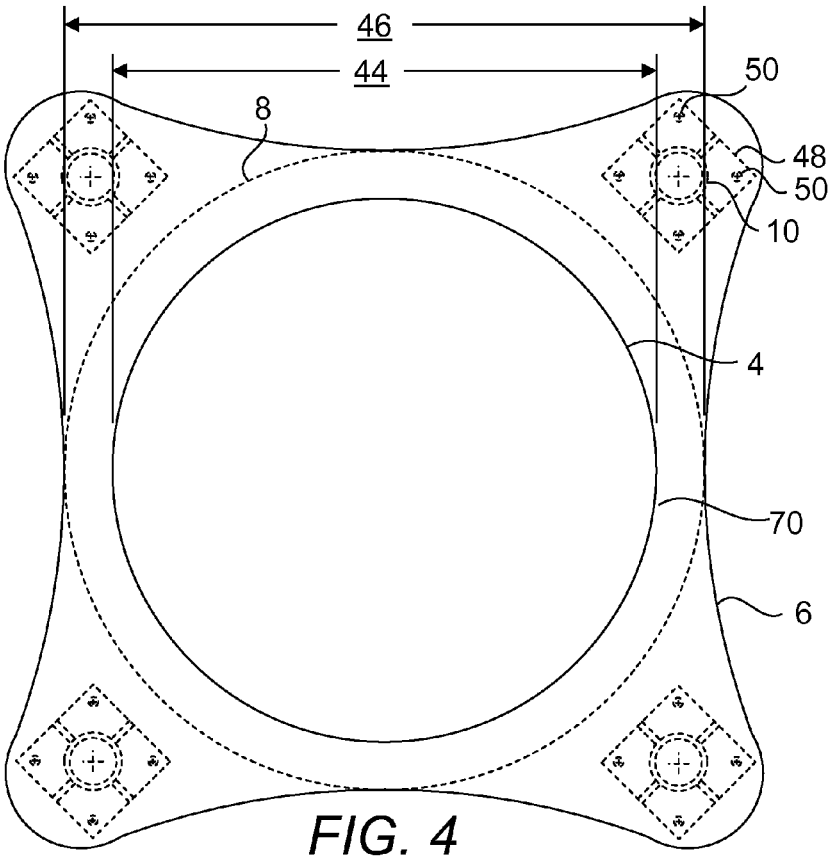
FIG. 4 is a partially transparent partial top orthogonal view of a present block disposed on a support tray.

FIG. 4 is a partially transparent partial top orthogonal view of a present block disposed on a support tray. The block 4 includes a width 44 and a thickness. The width 44 can range from about 10 inches to about 16 inches but preferably about 12 inches. The support tray 6 includes a top surface, a bottom surface, a width 46, a depressed portion on the surface and the support tray 6 is adapted to removably receive the block 4 on the top surface. The ratio of the block width and the support tray width ranges from about 6:7 to about 1:2 such that a sufficiently prominent flange 8 of the support tray is formed. The block 4 is seated in the depressed portion such that the flange 8 also forms a fringe 70 to contain the block 4. As the support tray 6 extends beyond the diametric periphery of the block, the flange aids in stopping a hammer from continuing to be swung downwardly in the event where a user misses, or glances the outer edge of the playing surface of the block. When the block is set in the depressed portion, a fringe is also formed around a portion of the side wall of the block in the vicinity of the bottom of block. Without the fringe, cracked edges can cause pieces of materials to be separated from the block and hit bystanders or the user. It shall be noted that the flange extends outwardly at four corners to provide a solid base for the attachment of leg sockets 10 via their respective leg socket securing plates 48.

Figure 5:
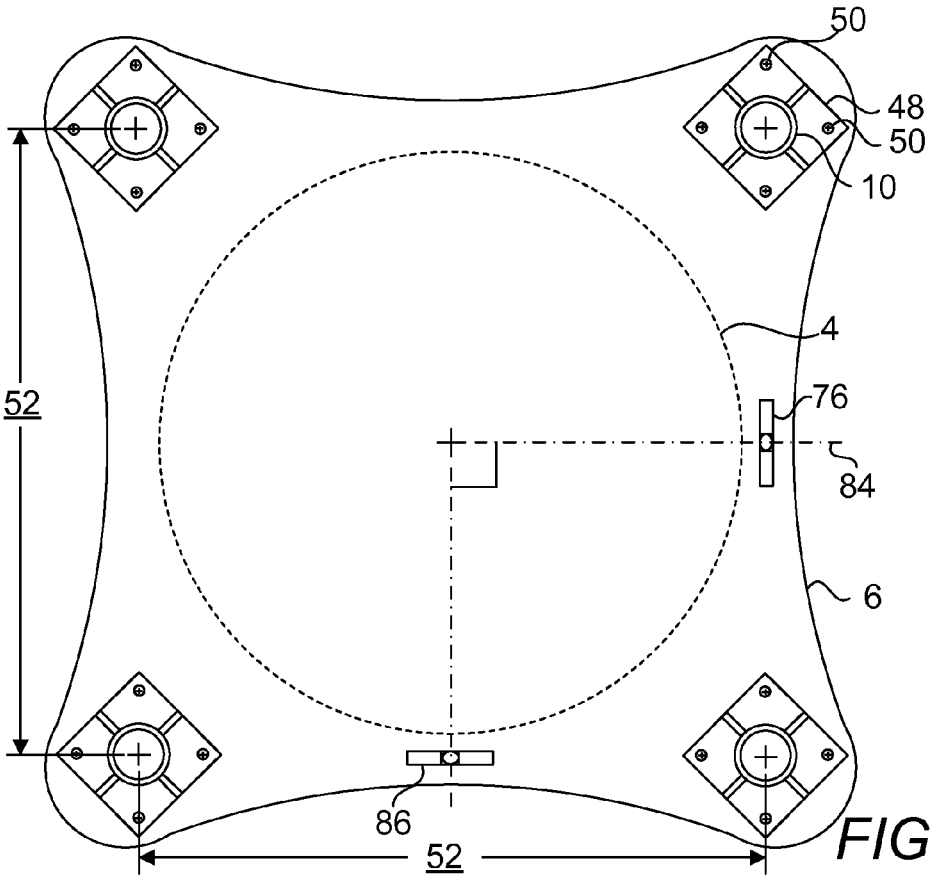
FIG. 5 is a partially transparent bottom orthogonal view of a present support tray.

FIG. 5 is a partially transparent bottom orthogonal view of a present support tray. In one embodiment, the distance 52 between adjacent leg sockets is preferably about 13 inches. Each leg socket 10 includes a socket securing plate 48 which is secured to the bottom surface of the support tray 6 using a plurality of fasteners 50. In the embodiment shown, two levels 76 are provided and mounted at substantially right angle to one another on the bottom surface of the support tray 6, each disposed about an axis of rotation 84, 86 of the support tray 6 to indicate an inclination with respect to its corresponding axis of rotation 84, 86. Each level 76 may alternatively be mounted on a side surface of the support tray 6, still away from potential strike locations of missed strikes. Players may use at least one of the levels as a guide to choose the ground on which the game pieces are set up. In making the game safer to play, the top surface of the block is preferably not only level with the ground but also level with a horizontal plane.

Figure 6:
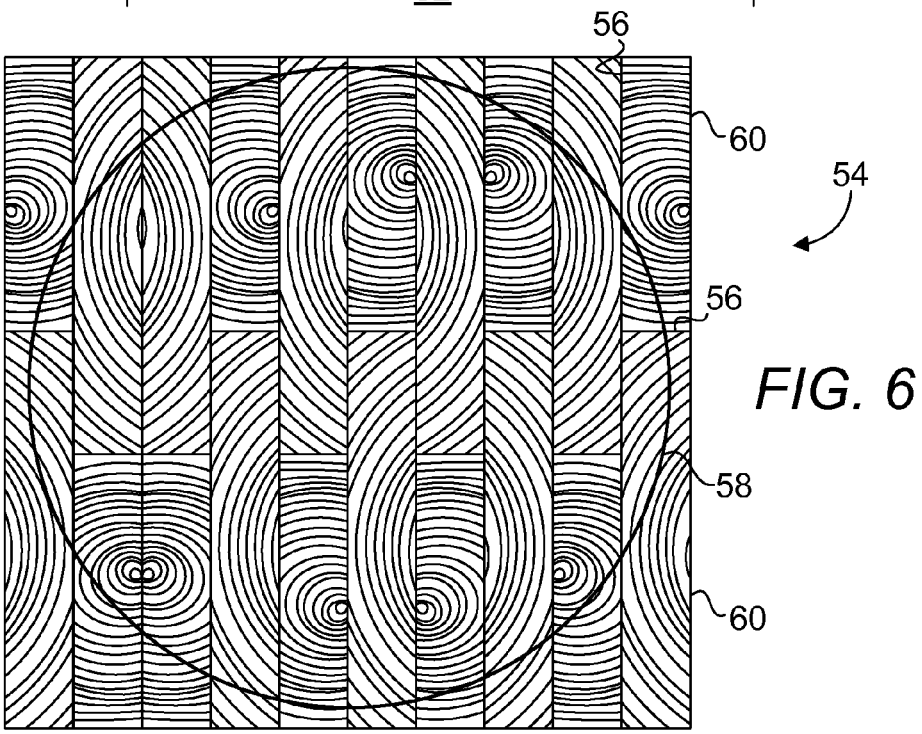
FIG. 6 depicts a glue laminated timber (glulam) block useful to be made into a material suitable to receive nails for the nail hammering game.
Figure 7:
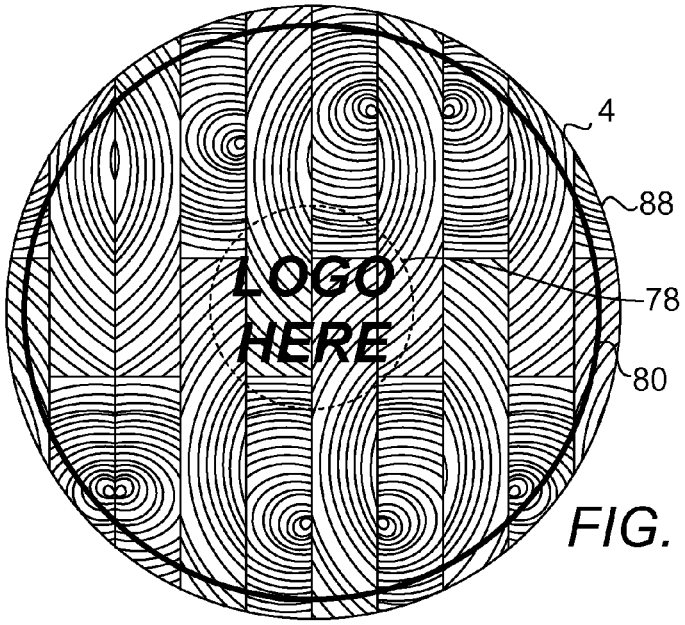
FIG. 7 depicts a glulam block having been cut into shape for use in one embodiment of the present game pieces.

FIG. 6 depicts a glulam block 54 useful to be made into a material suitable to receive nails for the nail hammering game. As the aggregate strips 60 are used for forming glulam come in rectangular blocks, the resulting glulam block is also rectangular. It shall be noted that seams 56 are formed as a result but they do not present problems in receiving nails. Rectangular blocks may readily be used to receive nails. However, in keeping with the tradition of the nail hammering game, rounded (or cylindrical) blocks are used as shown in FIG. 7. A rounded block may be cut out of the rectangular block depicted in FIG. 6 along outline 58. FIG. 7 depicts a glulam block having been cut into shape for use in one embodiment of the present game pieces. One advantage of the present block over a conventional block, e.g., naturally occurring block/trunk slice lies in the integrity, consistency and durability of the present block as compared to conventional blocks. Many conventional blocks tend to crack due to weathering as it is impractical to move conventional blocks to a shelter as the conventional blocks typically weigh significantly more than the present block. The size of the present block is suitably configured such that it offers a sufficiently large area for game play while being easily transportable. The grain direction of the present block is favorably aligned with the direction in which nails are to be driven into the block such that the block remains structurally intact and does not split prematurely despite repeated use. Suitable glulam block materials include spruce, hem fir, cottonwood, pine, basswood, larch or any type of wood having a density that falls within a density range of from about 20 to about 40 lbs/ft$^3$. If a block that comes in a single unit is preferred, a naturally occurring tree trunk slice is also suitable. However, the naturally occurring trunk slice will need to be larger in diameter than the final size of the block used in the present game pieces as the naturally occurring trunk slice is "turned" to a suitable size and shape for snug fit in the depression of the support tray.

Any wood slices or pieces used for the present block are preferably kiln dried for dimensional stability and sealed to prevent splitting. In one embodiment, the top surface of the block includes a marking 78, e.g., a logo or other branding information, e.g., website address, Quick Response (QR) code, etc. In one embodiment, the logo is laser etched in the center. In one embodiment, there is also disposed a marking 80 designating a "no play" area as it is too close to the edge of the block as it is high likely that a player will miss the playing surface while attempting to strike the nail. In one embodiment, this marking is a line etched at an offset of about 0.5 inch from the side wall of the block 4. In one embodiment, as the bottom surface of the block includes a depressed portion 66 and the support tray includes a raised portion 64, the designation of "no play" area at the centrally placed marking 78 steers players away from playing in this area. Also, the nail has a tendency to split the block out along the side wall of the block 4.

The choice of block material can be, but not limited to natural wood, glulam, Medium-Density Fiberboard (MDF) and Urethane Foam Board. If glulam is used, suitable grain orientation is important as a nail is more easily driven into the block consistently and driven into the block without causing splitting of the block if the grain is aligned with the direction in which the nail is driven into the block. In this case, the grain is preferably aligned vertically. Aggregate strips 60 of suitable sizes, e.g., rectangular blocks of widths ranging from about 1 inch to about 3 inches, are preferable to lower the chance that a defective piece will take up a good percentage of the block surface. Upon assembling and gluing aggregate strips 60 together and turning the block into its final shape, a sealant may be applied to outer surfaces of the properly shaped block to further enhance the binding of the aggregate strips 60. In general, solid and laminated materials, with or without specific grain orientation, may be used. Such materials provide consistent resistance to nail hammering although the appearance is considered less attractive than glulam or natural-looking wood surfaces.

Figure 8:
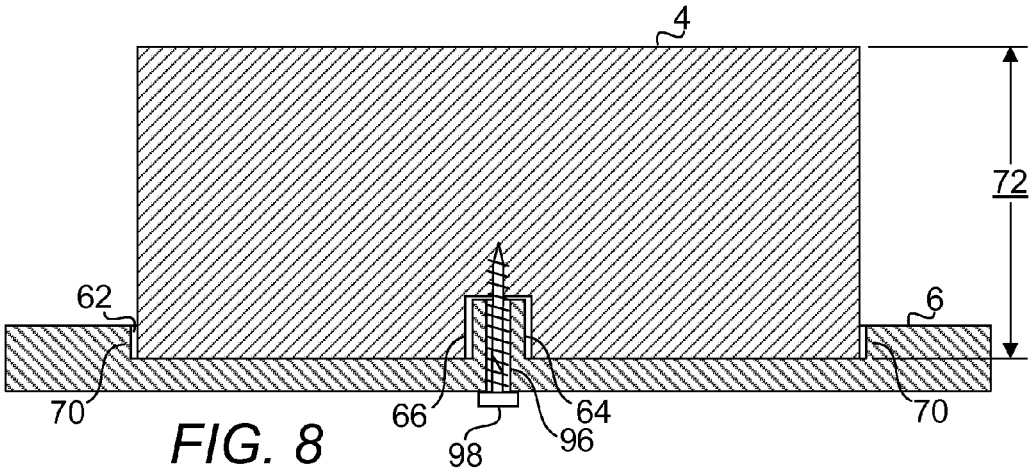
FIG. 8 is a cross-sectional orthogonal view of a present tray and its support tray.

FIG. 8 is a cross-sectional orthogonal view of a present tray and its support tray. In one embodiment, the block ranges from about 4 to about 6 inches thick 72. Applicants discovered that blocks 4 thicker than 6 inches are unnecessarily hefty and exert excessive weight for transport. Applicants also discovered that blocks thinner than 4 inches tend to disintegrate when the block is densely inserted with nails. In one embodiment, the support tray 6 further includes at least one key 64 disposed on a portion of the top surface of the depressed portion 74 of the support tray 6. This key 64 is configured to be coupled to a matching slot 66 of the block 4 to prevent movement of the block 4 relative to the support tray 6 and to prevent use of an unqualified block as it may not have the desirable properties, hardness or density, as disclosed elsewhere herein. Sufficient play 62 is preferably provided to ensure easy mounting and removal of the block in the depressed portion of the support tray 6. The play 62 shall however not be too large as to accommodate the striking end of a hammer or the hammer may become stuck between the support tray and the block. The use of key-slot matching portions also enhances the grip of the support tray 6 on the block 4, further securing the block 4. In the embodiment shown, the block 4 is further secured with a fastener, e.g., screw 98. In this case, a through hole 96 that is centrally disposed within the key 64 enables penetration of the screw 98 from the bottom of the support tray 6 to engage the block 4 within the slot. The block 4 may be delivered to an end user with the block already secured with one or more screws 96 or the user may be required to fasten the screw before use. The block 4 is not required to be separated from the support tray 6 after use unless if the block 4 has been fully consumed and that it needs to be replaced.

Figure 9:
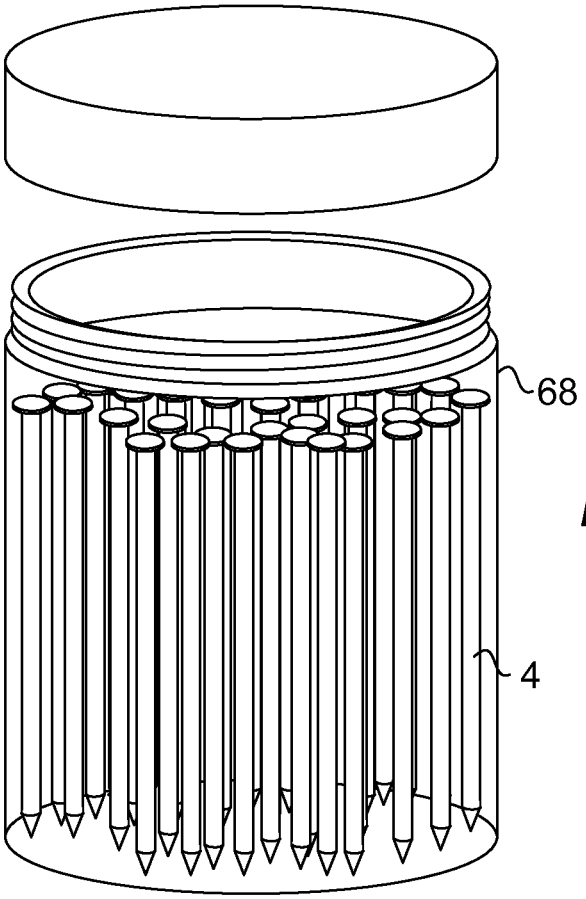
FIG. 9 depicts an example of the nails used in conjunction with the present game pieces.

FIG. 9 depicts an example of the nails used in conjunction with the present game pieces. Nails 18 are preferably housed in a container 68 to avoid spilling and to encourage proper accounting of the nails 18. Different types of nails were tested. Suitable nails include, but not limited to, 10 d common bright finish nails (with 0.148 inch shank diameter). Each nail is preferably about 3 inches long as at such length, the nail is not too short that it can be embedded in the block with one hit but not too long that it is impossible for a beginner to embed it completely. Applicants discovered that other finishes such as zinc dipped, ring type, coated sinkers are too tough to hit into the block. Cut nails are also discovered to be unsuitable as they act as miniature splitting wedges and tend to split the block when driven into the block.

Figure 10:
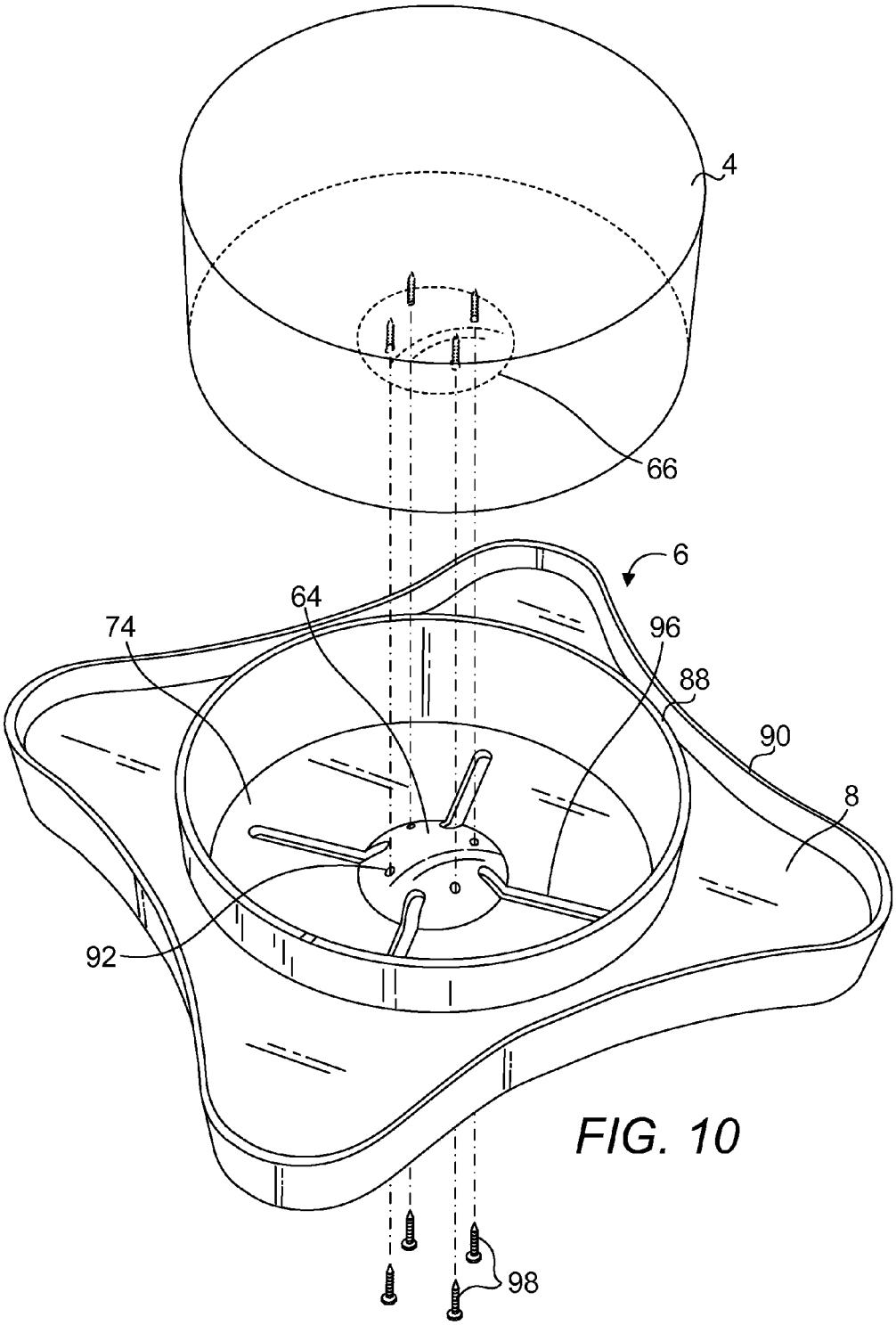
FIG. 10 is a partially transparent top perspective view of one embodiment of the present block and its corresponding support tray.
Figure 11:
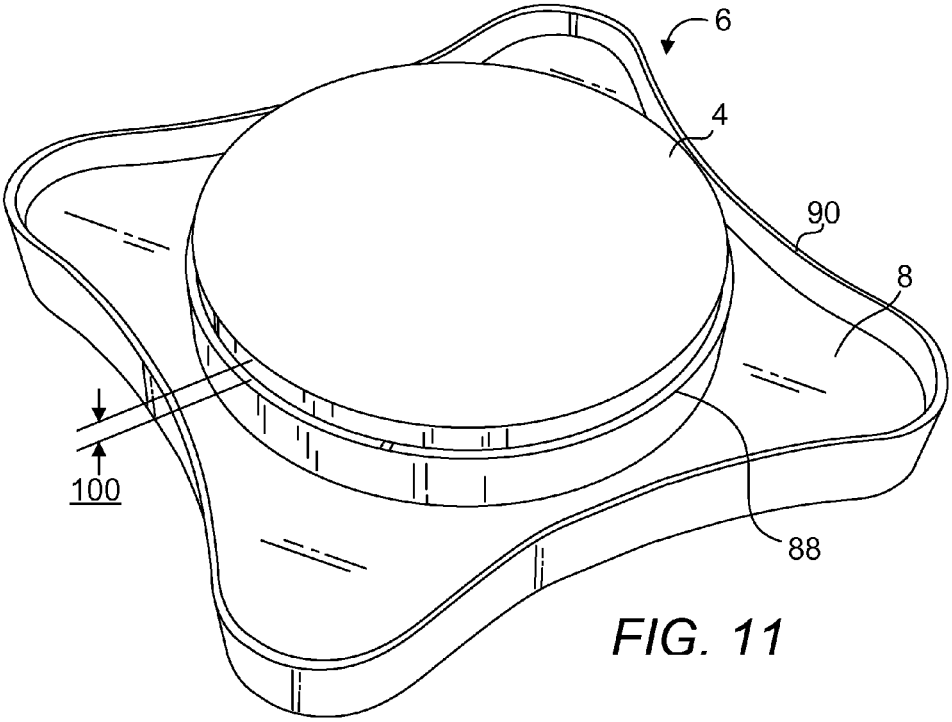
FIG. 11 is a top perspective view of the embodiment disclosed in FIG. 10 with the block disposed in a seated and secured position.

FIG. 10 is a partially transparent top perspective view of one embodiment of the present block 4 and its corresponding support tray 6. In this embodiment, the key 64 is essentially a dome disposed centrally in the depressed portion 74 of the support tray 6. Four apertures 92 are disposed on the dome to enable penetration of four screws 98 from the bottom surface of the support tray 6 to secure the block 4 at its matching slot 66. One notable difference between the key-slot combination of FIG. 10 and that of FIG. 8 lies in the shape of the key 64 of FIG. 10 which enables it to cause auto-centering of the block with its matching slot 66. As such, the block 4 can be more easily aligned with the key 64 before the screws 98 are tightened to secure the block 4 against the support tray 6 to prevent movement of the block 4 relative to the support tray 6. Applicants discovered that by scaling down the block 4 as compared to conventional blocks, the present block 4 becomes transportable but more easily moved relative to its support tray when struck. The screws 98 aid in securing the block 4 and transferring or lessening strike forces experienced by the block 4 to the support tray and leg structure. Slots 96 that extend outwardly from the key 64 are provided such that if the key 64 is intentionally removed (e.g., to accommodate a non-qualified block), the support tray 6 will not properly support the block 4 as there will be insufficient material centrally disposed in the depressed portion 74 to securely hold the block 4. It shall also be noted that in this embodiment, a wall 88 extending upwardly from the periphery of the depressed portion 74 provides additional barrier to confine separated pieces of a block 4 from leaving the depressed portion 74. Again, the play between the block and the wall 88 shall not be too large as to accommodate the striking end of a hammer or the hammer may become stuck between the support tray and the block. A wall 90 that extends upwardly along the periphery of the flange 8 provides a further barrier for any missed strikes as they act to arrest these strikes from continuing in their trajectories downwardly toward the user. FIG. 11 is a top perspective view of the embodiment disclosed in FIG. 10 with the block 4 disposed in a seated and secured position. It shall be noted that upon being seated, the block preferably protrudes by a distance 100 of from about 0.25 inch to about 0.5 inch from the top end of the wall 88 around the block 4.

In one embodiment, it is also conceivable to have a leg structure that is adjustable in height to suit users of all builds and sizes. In one embodiment not shown, a second leg structure that is capable of a different height is provided. In yet another embodiment not shown, each leg is made adjustable in length, e.g., via a lockable telescopic mechanism.

There is further provided a carrying bag for holding the leg structure, hammer and nails. Suitable bags include, but not limited to banjo style case (having a cylindrical portion for holding a cylindrically shaped block and an elongated portion where a collapsed leg structure can be stored), a folding chair bag, a soft sided cooler, a tube can cooler and a tool belt. It is also possible that the block can be carried separately from the leg structure to further separate the weights so that they may be hauled more efficiently or even in separate trips so as not to over burden a user. The act of transporting the block separately also increases the possibility that the playing surface (which may include a logo and other marketing information) of the block can be exposed. In addition, a bag may also be equipped with a handle or strap to facilitate grasping of the bag, storage pockets for nails, hammer holster for securing a hammer, etc. In other embodiments, other accessories, e.g., bottle opener, cup holder, etc., may be added to the bag and/or the support tray or the leg structure.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A collection of game pieces comprising:

(a) a block having a top surface, a first width and a thickness; and (b) a support tray having a top surface, a bottom surface, a second width, wherein said support tray is adapted to removably receive said block centrally on said top surface, and wherein the ratio of said first width and said second width ranges from about 6:7 to about 1:2 such that a flange of said support tray is formed and said top surface of said support tray further comprises a depressed portion adapted to form a fringe to secure said block, whereby said block is configured to receive a plurality of nails driven into it using a striking tool and if the striking tool accidentally misses said block while used in driving a nail into said block, said flange is used to arrest the striking motion of the striking tool.

2. The collection of game pieces of claim 1, further comprising at least one leg socket adapted to said bottom surface of said support tray.

3. The collection of game pieces of claim 2, further comprising a leg structure removably connected to said at least one leg socket to support said support tray.

4. The collection of game pieces of claim 3, wherein said leg structure is collapsible to facilitate transport of said leg structure.

5. The collection of game pieces of claim 3, wherein said leg structure comprises four legs capable of being erected in a rectangular stance.

6. The collection of game pieces of claim 5, wherein each of said four legs comprises a bottom end and a foot disposed on the bottom end of said each of said four legs.

7. The collection of game pieces of claim 6, further comprising an aperture disposed on at least one of said feet, wherein said aperture is adapted to receive a stake.

8. The collection of game pieces of claim 1, wherein said block comprises a material having a density of from about 20 to about 40 $lbs/ft^3$.

9. The collection of game pieces of claim 1, wherein said block comprises a material having a Janka hardness of from about 350 to about 550.

10. The collection of game pieces of claim 1, wherein said block comprises a material selected from the group consisting of natural wood, glulam, Medium-Density Fiberboard (MDF) and Urethane Foam Board.

11. The collection of game pieces of claim 1, further comprising a carrying strap having two ends, each end adapted to a portion of said support tray to facilitate transport of said support tray.

12. The collection of game pieces of claim 1, the size of each of said plurality of nails is about 10 d.

13. The collection of game pieces of claim 1, wherein the thickness of said block ranges from about 4 inches to about 6 inches and the first width ranges from about 10 inches to about 16 inches.

14. The collection of game pieces of claim 1, wherein the thickness of said block ranges from about 4 inches to about 6 inches.

15. The collection of game pieces of claim 1, wherein said top surface of said block further comprising a marking designation disposed at a pre-determined distance from a side wall of said block.

16. The collection of game pieces of claim 1, further comprising at least one level for indicating inclination of said support tray about one axis of rotation.

17. A collection of game pieces comprising:

(a) a block having a top surface, a first width and a thickness; and (b) a support tray having a top surface, a bottom surface, a second width, wherein said support tray is adapted to removably receive said block centrally on said top surface, and wherein the ratio of said first width and said second width ranges from about 6:7 to about 1:2 such that a flange of said support tray is formed and said top surface of said support tray further comprises at least one key configured to be coupled to a matching slot of said block to prevent movement of said block relative to said support tray and to prevent use of an unqualified block, whereby said block is configured to receive a plurality of nails driven into it using a striking tool and if the striking tool accidentally misses said block while used in driving a nail into said block, said flange is used to arrest the striking motion of the striking tool.

18. A collection of game pieces comprising:

(a) a block having a top surface, a first width and a thickness;

(b) a support tray having a top surface, a bottom surface, a second width, wherein said support tray is adapted to removably receive said block centrally on said top surface, and wherein the ratio of said first width and said second width ranges from about 6:7 to about 1:2 such that a flange of said support tray is formed; and (c) a wall extending upwardly from the periphery of said flange, whereby said block is configured to receive a plurality of nails driven into it using a striking tool and said flange and said wall are configured to arrest the striking motion of the striking tool that misses said block and to contain any inadvertently separated edges of said block from leaving said support tray.

* * * * *